US010253675B2

(12) United States Patent
Fan et al.

(10) Patent No.: US 10,253,675 B2
(45) Date of Patent: Apr. 9, 2019

(54) EXHAUST POSTPROCESSING COMPONENT

(71) Applicant: TENNECO (SUZHOU) EMISSION SYSTEM CO., LTD., Kunshan Suzhou, Jiangsu (CN)

(72) Inventors: Gaofeng Fan, Kunshan Suzhou (CN); Zhenqiu Yang, Kunshan Suzhou (CN); Haitao Zhang, Kunshan Suzhou (CN)

(73) Assignee: TENNECO (SUZHOU) EMISSION SYSTEM CO., LTD., Kunshan Suzhou, Jiangsu (CN)

( * ) Notice: Subject to any disclaimer, the term of this patent is extended or adjusted under 35 U.S.C. 154(b) by 0 days.

(21) Appl. No.: 15/528,430

(22) PCT Filed: Nov. 12, 2015

(86) PCT No.: PCT/CN2015/094450
§ 371 (c)(1),
(2) Date: May 19, 2017

(87) PCT Pub. No.: WO2016/078539
PCT Pub. Date: May 26, 2016

(65) Prior Publication Data

US 2017/0328261 A1 Nov. 16, 2017

(30) Foreign Application Priority Data

Nov. 21, 2014 (CN) ..... 2014 1 0671762

(51) Int. Cl.
*F01N 3/00* (2006.01)
*F01N 13/08* (2010.01)
(Continued)

(52) U.S. Cl.
CPC ..... *F01N 13/08* (2013.01); *F01N 3/20* (2013.01); *F01N 13/00* (2013.01); *F01N 13/008* (2013.01);
(Continued)

(58) Field of Classification Search
USPC ..... 60/274, 286, 295, 297, 301, 303, 324
See application file for complete search history.

(56) References Cited

U.S. PATENT DOCUMENTS 8,959,895 B2 * 2/2015 Zapf ..... F01N 3/2066 60/286
9,359,928 B2 * 6/2016 Fan ..... F01N 3/2066
(Continued)

FOREIGN PATENT DOCUMENTS

CN 101493027 A 7/2009
CN 203098002 U 7/2013
(Continued)

OTHER PUBLICATIONS

European Search Report, dated Jun. 22, 2018.

*Primary Examiner* — Binh Q Tran
(74) *Attorney, Agent, or Firm* — Harness, Dickey & Pierce, P.L.C.

(57) ABSTRACT

An exhaust postprocessing component comprises an exhaust pipe, a first support installed on the exhaust pipe, a common rail installed on the first support, an inlet pipeline and an outlet pipeline that are connected to the common rail, a sensor, and a bundle that is connected to the sensor. The common rail comprises a shell and a pressure detection apparatus and a pressure adjustment apparatus that are installed on the shell. The shell comprises an inlet passage and an outlet passage. The pressure detection apparatus is connected to the inlet passage. The pressure adjustment apparatus is connected between the inlet passage and the outlet passage, so as to connect or disconnect the inlet passage and the outlet passage. The engine exhaust post-processing component further comprises a second support. The bundle, the inlet pipeline, and the outlet pipeline are all gathered at the second support. In this way, the exhaust
(Continued)

postprocessing component is easy to be installed with another component.

10 Claims, 12 Drawing Sheets

(51) Int. Cl.
*F01N 3/20* (2006.01)
*F01N 13/00* (2010.01)
*F01N 13/18* (2010.01)

(52) U.S. Cl.
CPC ..... *F01N 13/18* (2013.01); *F01N 2610/14* (2013.01); *F01N 2610/144* (2013.01); *F01N 2610/1433* (2013.01); *F01N 2610/1466* (2013.01); *F01N 2610/1473* (2013.01); *F01N 2900/1808* (2013.01)

(56) References Cited

U.S. PATENT DOCUMENTS 9,874,131 B2 * 1/2018 Ryu ..... F01N 3/206
2006/0101810 A1 * 5/2006 Angelo ..... F01N 3/0253 60/286
2008/0314027 A1 * 12/2008 Barber ..... B01D 53/90 60/286
2014/0238504 A1 8/2014 Kregling et al.
2014/0290224 A1 10/2014 Kanamori
2016/0030886 A1 * 2/2016 Dougnier ..... F01N 3/2066 435/303.2
2017/0122172 A1 5/2017 Fan

FOREIGN PATENT DOCUMENTS

CN 203669975 U 6/2014
CN 204267135 U 4/2015
CN 204267138 U 4/2015
CN 104763497 A 7/2015
CN 204646374 U 9/2015
DE 102006019051 A1 10/2007

* cited by examiner

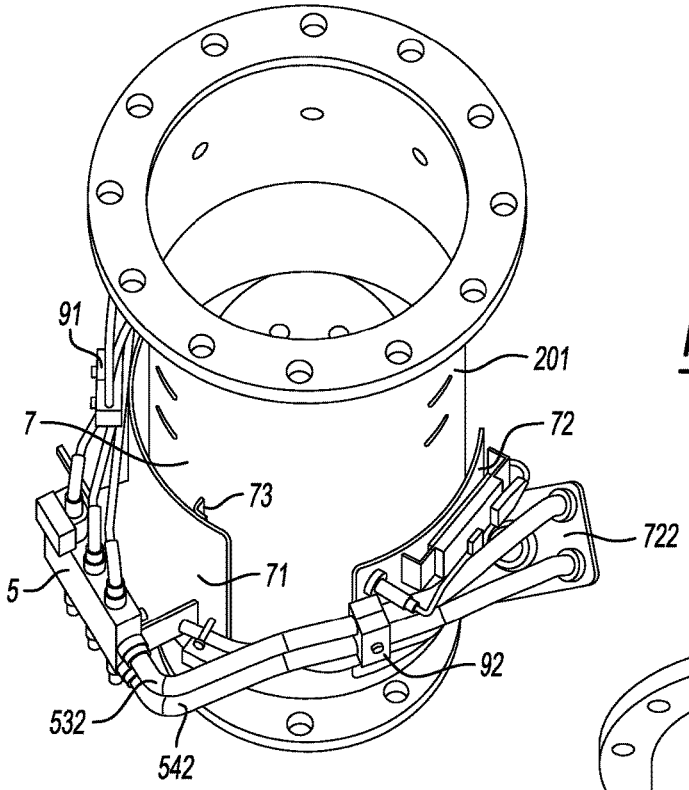
Fig-12
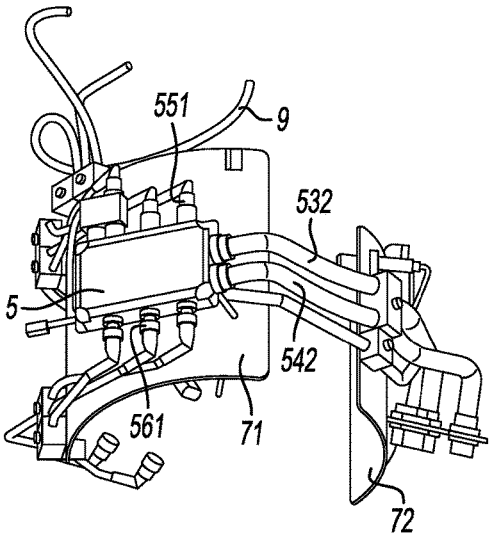
Fig-13
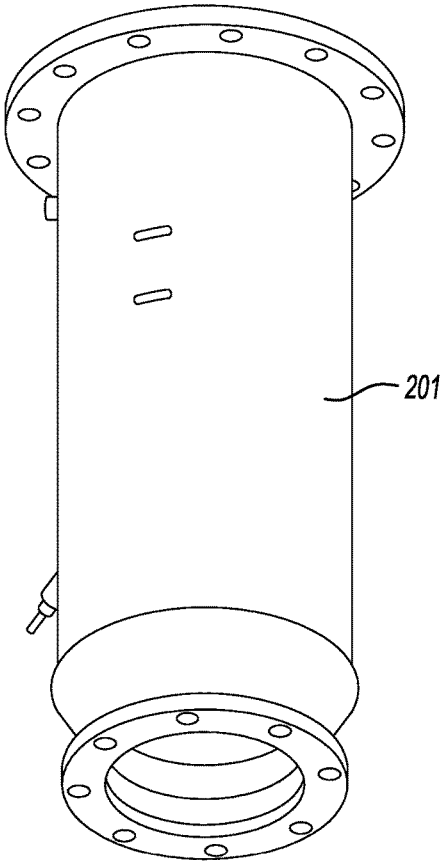

EXHAUST POSTPROCESSING COMPONENT

CROSS REFERENCE TO RELATED APPLICATIONS

This application is a U.S. National Phase Application under 35 U.S.C. 371 of International Application No. PCT/CN2015/094450 filed on Nov. 12, 2015 and published in Chinese as WO 2016/078539 A1 on May 26, 2016. This application is based on and claims the benefit of priority from Chinese Patent Application No. 201410671762.4 filed Nov. 21, 2014. The entire disclosures of all of the above applications are incorporated herein by reference.

TECHNICAL FIELD

The present invention relates to an exhaust postprocessing component, belonging to the technical field of engine exhaust postprocessing.

BACKGROUND ART

As the standards for exhaust emission in various countries all over the world are increasingly becoming more strict, higher requirements are put forward for a urea injection system used for exhaust processing. A conventional exhaust postprocessing system generally comprises a urea injection system and various sensor elements mounted on an exhaust pipe. The urea injection system comprises a urea tank, a pump, and nozzles. is The above-mentioned urea tank, pump and nozzles are generally connected to one another with various pipelines. A problem that arises is the very large number of pipelines, causing confusion.

Furthermore, the above-mentioned problem is especially obvious with exhaust postprocessing in high-power engines, and erroneous mounting occurs comparatively easily.

Thus, there is a need to provide an integrated exhaust postprocessing component for solving the above-mentioned problem.

SUMMARY OF THE INVENTION

The aim of the present invention is to provide an exhaust postprocessing component that facilitates mounting with other assemblies.

To achieve the above-mentioned aim, the following technical solution is adopted for the present invention: an exhaust postprocessing component, comprising an exhaust pipe, a first support mounted on said exhaust pipe, a common rail mounted on said first support, an inlet pipeline and an outlet pipeline connected to said common rail, a sensor, and a wiring harness connected to said sensor; said common rail comprises a housing, and a pressure detecting device and a pressure adjusting device installed on said housing, said housing comprising an inlet passage and an outlet passage, said pressure detecting device being connected to said inlet passage; said pressure adjusting device being connected between said inlet passage and said outlet passage, to be capable of connecting or disconnecting said inlet passage and said outlet passage; and said engine exhaust postprocesing component further comprises a second support, said wiring harness, said inlet pipeline and said outlet pipeline being gathered at said second support.

As a further improved technical solution of the present invention, said exhaust postprocessing component is provided with a mounting block disposed between said first support and said exhaust pipe to create a clearance between said first support and said exhaust pipe.

As a further improved technical solution of the present invention, said mounting block is welded to said exhaust pipe; said exhaust postprocessing component is further provided with heat insulation cotton filled in said clearance.

As a further improved technical solution of the present invention, said exhaust postprocessing component is provided with a pair of mounting plates for mounting said common rail onto said first support, said pressure adjusting device being located between said pair of mounting plates.

As a further improved technical solution of the present invention, one end of said mounting plate is welded to said first support, and the other end of said mounting plate is fixed by screws to the housing of said common rail.

As a further improved technical solution of the present invention, said second support comprises a fixed portion directly or indirectly fixed to said exhaust pipe and a mounting portion forming an included angle with said fixed portion, said mounting portion being provided with a plurality of mounting holes, and said wiring harness, said inlet pipeline and said outlet pipeline all being gathered in a corresponding mounting hole.

As a further improved technical solution of the present invention, said fixing portion and said mounting portion are formed by bending a metal plate, said mounting portion being perpendicular to said fixed portion.

As a further improved technical solution of the present invention, said housing comprises a plurality of conveyance ports connected to said inlet pipeline and a plurality of back-flow ports connected to said outlet passage, said housing roughly taking the shape of a cuboid, comprising a first end face, a second end face, a third end face, and a fourth end face, wherein said first end face and said second end face are disposed opposite each other, and said third end face and said fourth end face are disposed opposite each other; said inlet passage and said outlet passage pass through said first end face and/or said second end face, said conveyance port passing through said third end face, said back-flow port passing through said fourth end face.

As a further improved technical solution of the present invention, said common rail is provided with conveyance connectors connected to each conveyance port and back-flow connectors connected to each back-flow port, said inlet passage and said outlet passage being parallel to each other, said conveyance connectors being perpendicular to said inlet passage, said back-flow connectors being perpendicular to said outlet passage.

As a further improved technical solution of the present invention, the number of said back-flow connectors is the same as the number of said conveyance connectors; the direction of said conveyance connectors is opposite that of said back-flow connectors, and each of the conveyance ports is aligned with the corresponding back-flow port.

Compared with the prior art, the present invention, by gathering an inlet pipeline, an outlet pipeline, and a wiring harness on said second support, integrates the entire component, facilitating mounting with other assemblies.

BRIEF DESCRIPTION OF THE DRAWINGS

FIG. 12 shows yet another three-dimensional view of the exhaust postprocessing component shown in FIG. 10.

FIG. 13 shows a local exploded view of an exhaust postprocessing component according to the present invention.

SPECIFIC EMBODIMENTS

Figure 1:
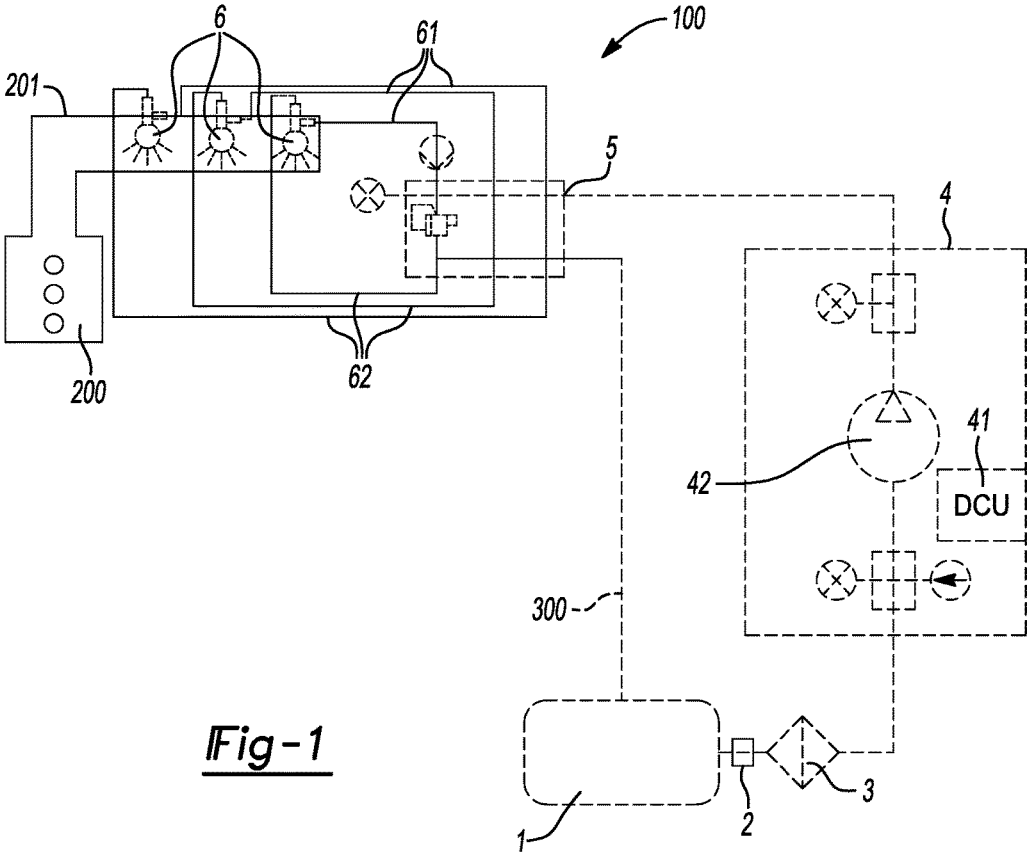
FIG. 1 shows a schematic diagram for a urea injection system used for exhaust processing in engines.

As shown in FIG. 1, the present invention discloses a urea injection system (100), which can be applied to an exhaust processing in an engine (200). Said urea injection system (100) comprises a urea tank (1), a sensor integration device (2) connected to said urea tank (1), a filter (3) connected downstream of said sensor integration device (2), a fluid conveying device (4) used to pump a urea solution out of said urea tank (1), a common rail (5) connected to said fluid conveying device (4), and nozzles (6) connected to said common rail (5). Said fluid conveying device (4) comprises a pump (42) used to pump a urea solution from said urea tank (1) and a controller (41) used to control said urea injection system (100). In the illustrated implementation mode of the present invention, said controller (41) is arranged in said fluid conveying device (4). Certainly, said controller (41) can also be arranged in another place in another implementation mode of the present invention.

Said engine (200) is a high-power diesel engine with a power rating above 500 kilowatts. Accordingly, it can be understood that the present invention relates to a common rail (5) applied to a high-power diesel engine. Since the power of said engine (200) is high, in order to achieve a satisfactory exhaust processing effect, a plurality of said nozzles (6) are provided in the illustrated implementation mode of the present invention. Under the control of said controller (41), said nozzles (6) are used to inject a urea solution into an exhaust pipe (201). The atomized urea solution is decomposed into ammonia in said exhaust pipe (201), and said ammonia reacts with nitrogen oxides in the engine exhaust to reduce the emission of nitrogen oxides. Considering that the principle of such exhaust processing technology is known to those of ordinary skill in the art, a detailed description of it is omitted here.

As shown in FIG. 2 to FIG. 8, said common rail (5) is used to adjust the pressure in the urea injection system. To be specific, said common rail (5) comprises a housing (50), a pressure detecting device (51) and a pressure adjusting device (52) mounted on said housing (50), an inlet connector (53) connected to said fluid conveying device (4) with a high-pressure pipeline, and an outlet connector (54) connected to said urea tank (1) with a back-flow pipeline (300).

Figure 2:
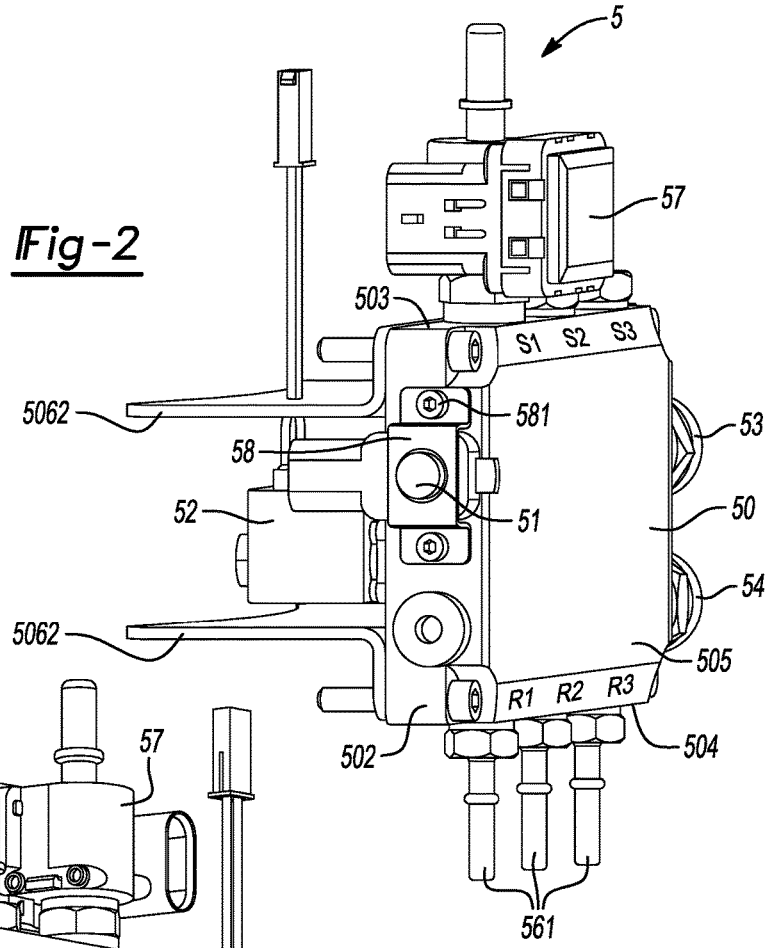
FIG. 2 shows a three-dimensional view of the common rail shown in FIG. 1.
Figure 3:
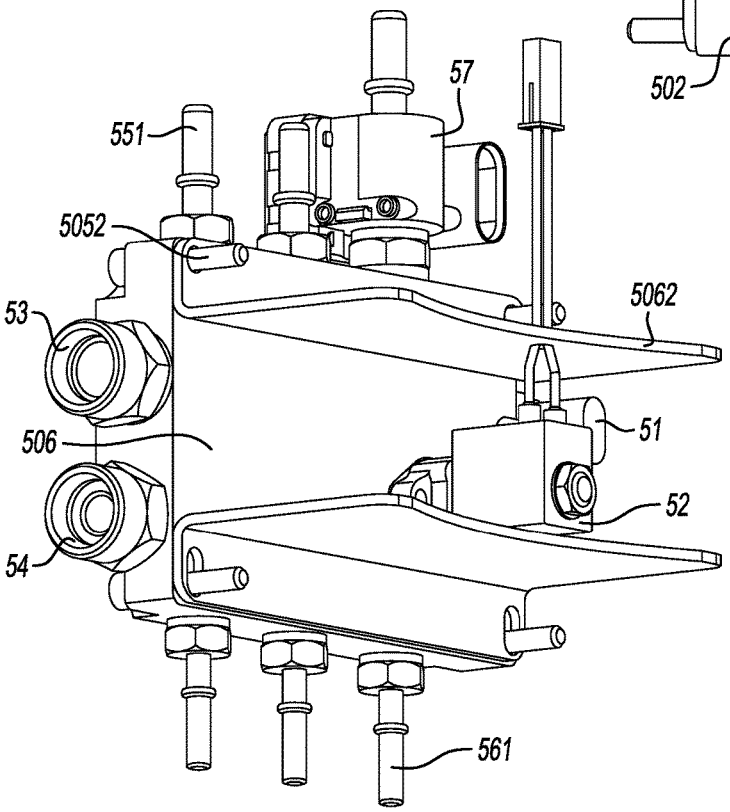
FIG. 3 shows another three-dimensional view of the common rail shown in FIG. 2.
Figure 4:
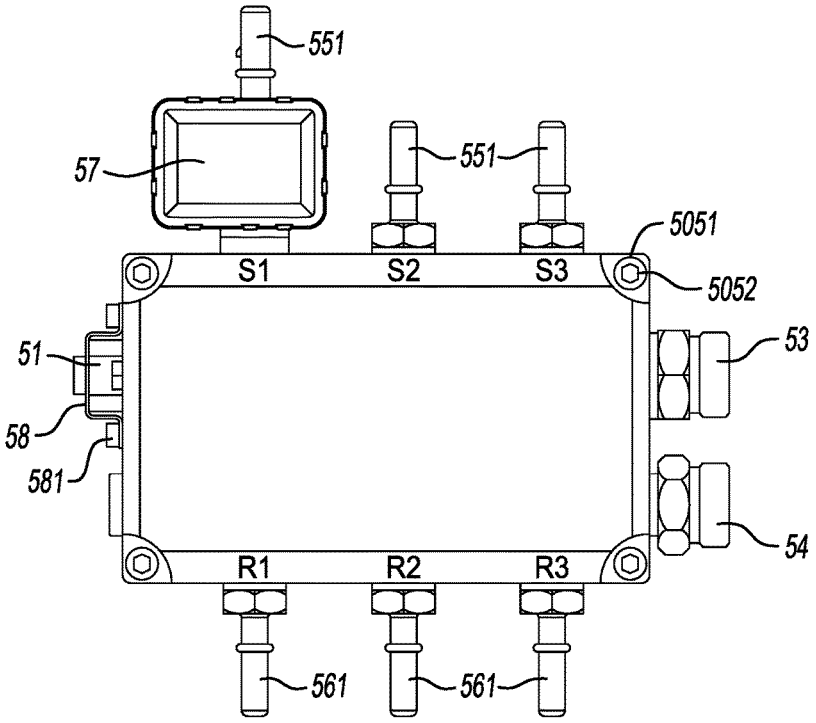
FIG. 4 shows a front view of a common rail according to the present invention.
Figure 5:
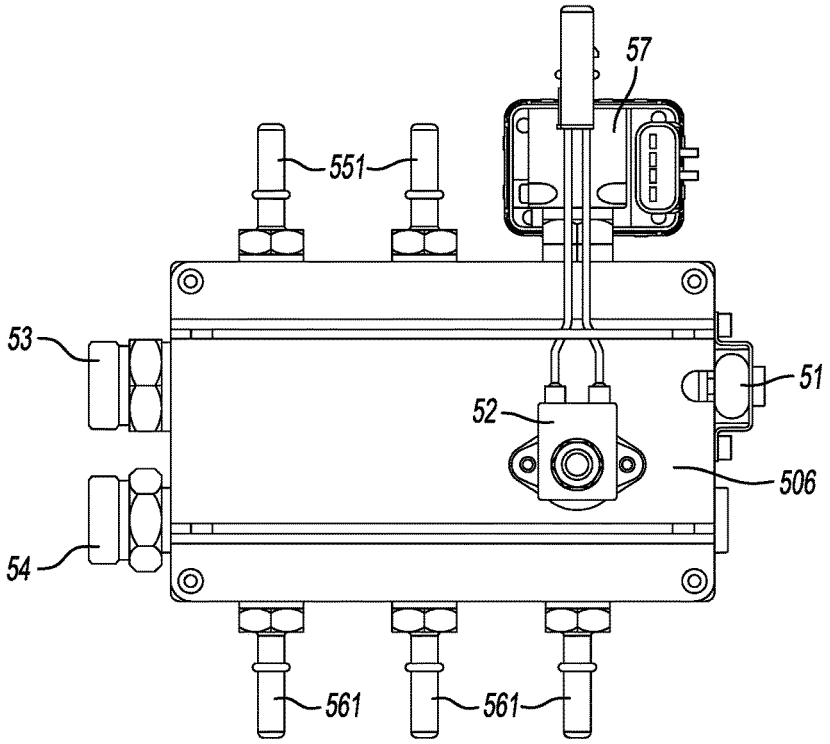
FIG. 5 shows a rear view of a common rail according to the present invention.
Figure 6:
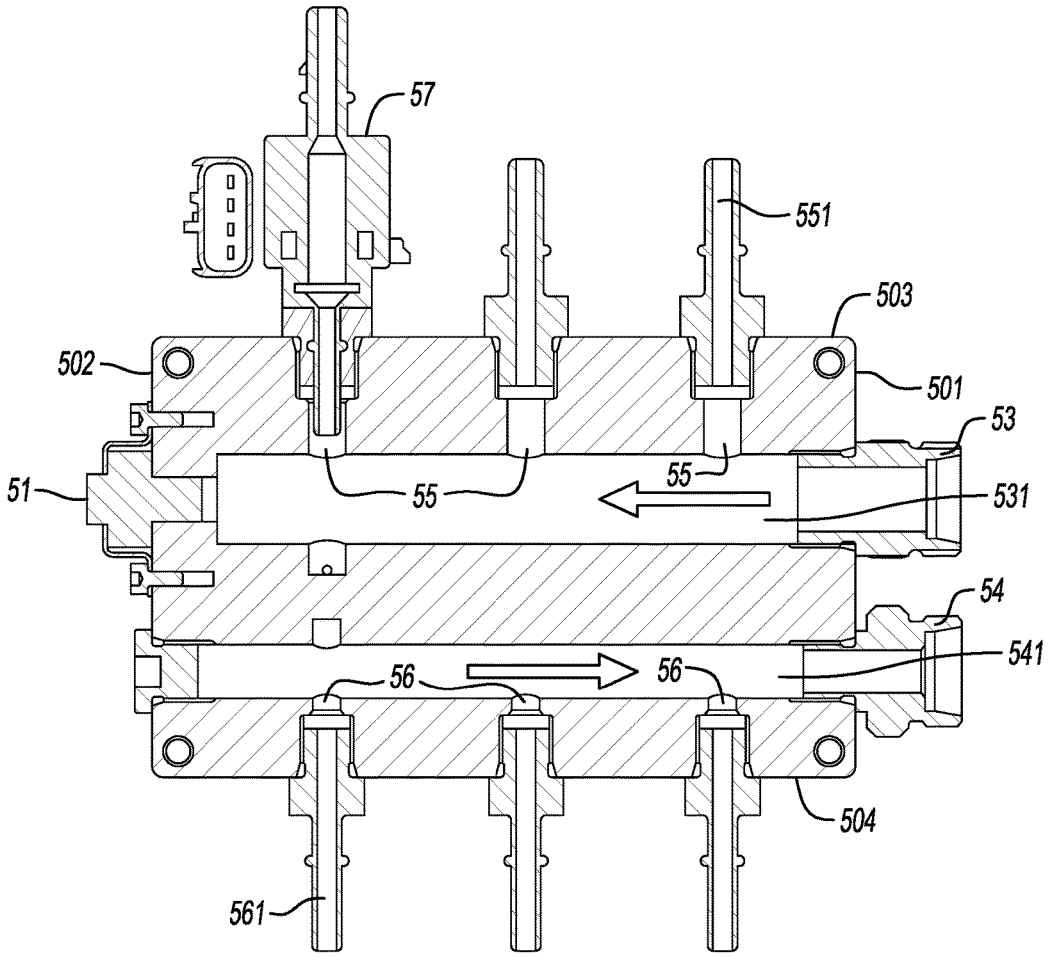
FIG. 6 shows a cutaway view of a common rail according to the present invention.
Figure 8:
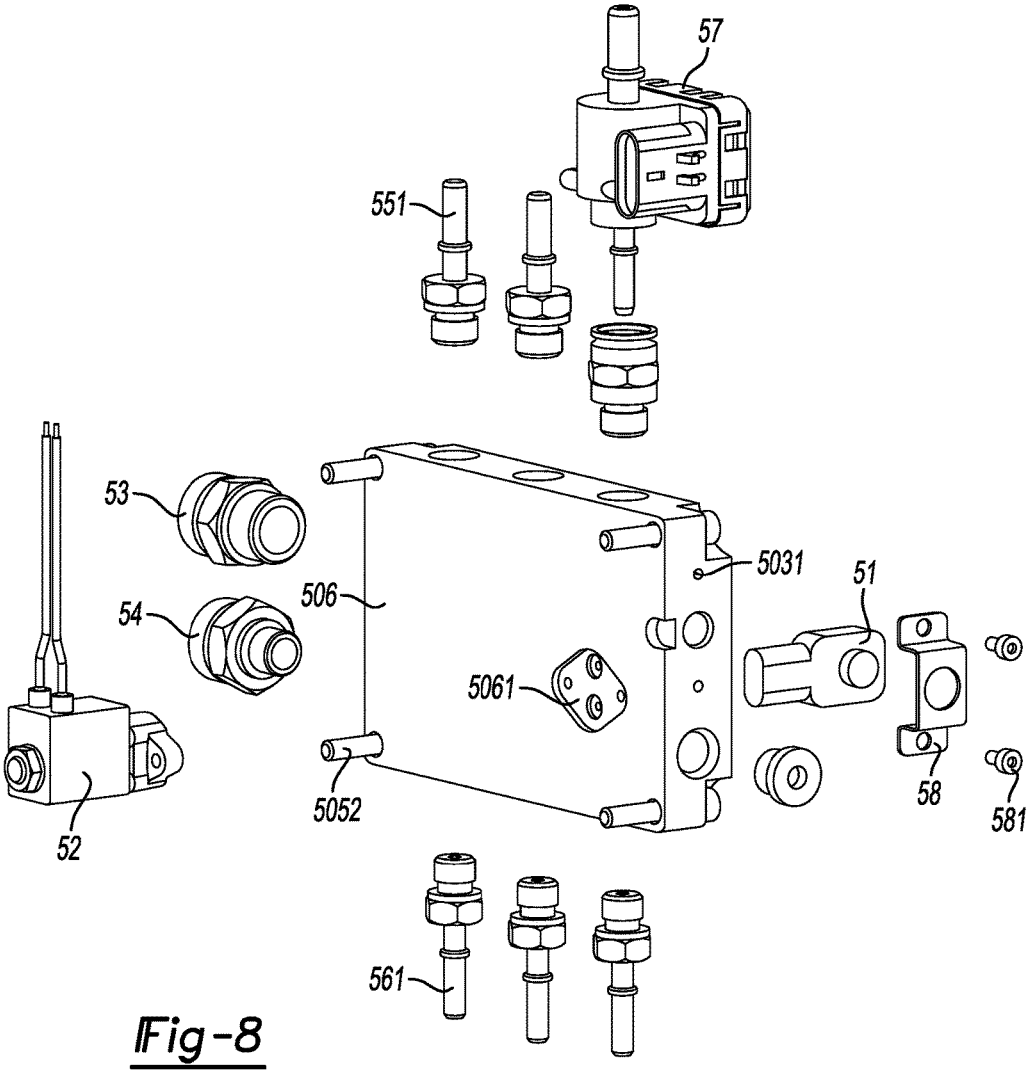
FIG. 8 shows another exploded three-dimensional view of the common rail shown in FIG. 7.

As shown in FIG. 6. said housing (50) roughly takes the shape of a cuboid, comprising a first end face (501), a second end face (502), a third end face (503), a fourth end face (504), a front face (505), and a back face (506) opposite to said front face (505), wherein, said first end face (501) is arranged opposite said second end face (502); said third end face (503) is arranged opposite said fourth end face (504); said front face (505) is perpendicular to all of said first end face (501), second end face (502), third end face (503), and fourth end face (504). As shown in FIG. 4, a mounting hole (5051) is provided at each of the four corners of said front face (505). As shown in FIG. 8 and FIG. 2, a mounting groove (5061) and a pair of mounting plates (5062) located on the two sides of said mounting groove (5061) are provided on said back face (506). Said common rail (5) is further equipped with screws (5052) used to lock with said mounting holes (5051) to fasten said common rail (5) onto said mounting plates (5062). Said inlet connector (53) and said outlet connector (54) are installed on said first end face (501) and/or said second end face (502). In the illustrated implementation mode of the present invention, said inlet connector (53) and said outlet connector (54) are installed on said first end face (501). Said second end face (502) is equipped with threaded holes (5021), and in the illustrated implementation mode of the present invention, said pressure detecting device (51) is a pressure sensor, which is installed on said second end face (502) and connects with said inlet passage (531). In the illustrated implementation mode of the present invention, said pressure adjusting device (52) is a pressure control valve, which is installed in said mounting groove (5061) and is located between said mounting plates (5062). With such settings, said mounting plates (5062) can protect said pressure control valve. Functionally, said pressure control valve is connected between said inlet passage (531) and said outlet passage (541), and said pressure control valve can connect or disconnect said inlet passage (531) and said outlet passage (541). For example, when said pressure sensor detects that the pressure in said inlet passage (531) is greater than a set value, said controller (41) opens said pressure control valve to realize pressure relief.

As shown in FIG. 6, the common rail (5) in the present invention is quite different from the prior common rail for fuel injection. First of all, a lot of data analysis shows that the pressure which the common rail (5) of the present invention, applied in the urea injection system, needs to withstand is far lower than what the common rail for fuel injection withstands. Based on such analysis, the cuboid housing (50) disclosed in the present invention has high machinability. More importantly, this provides a feasible solution for the integration of the outlet passage (541) into said common rail (5). In the illustrated implementation mode of the present invention, the diameter of said inlet passage (531) is of course greater than the diameter of said outlet passage (541). The reason for such a design is that scientific analysis shows that the pressures which said inlet passage (531) and said outlet passage (541) need to withstand are also different.

Figure 7:
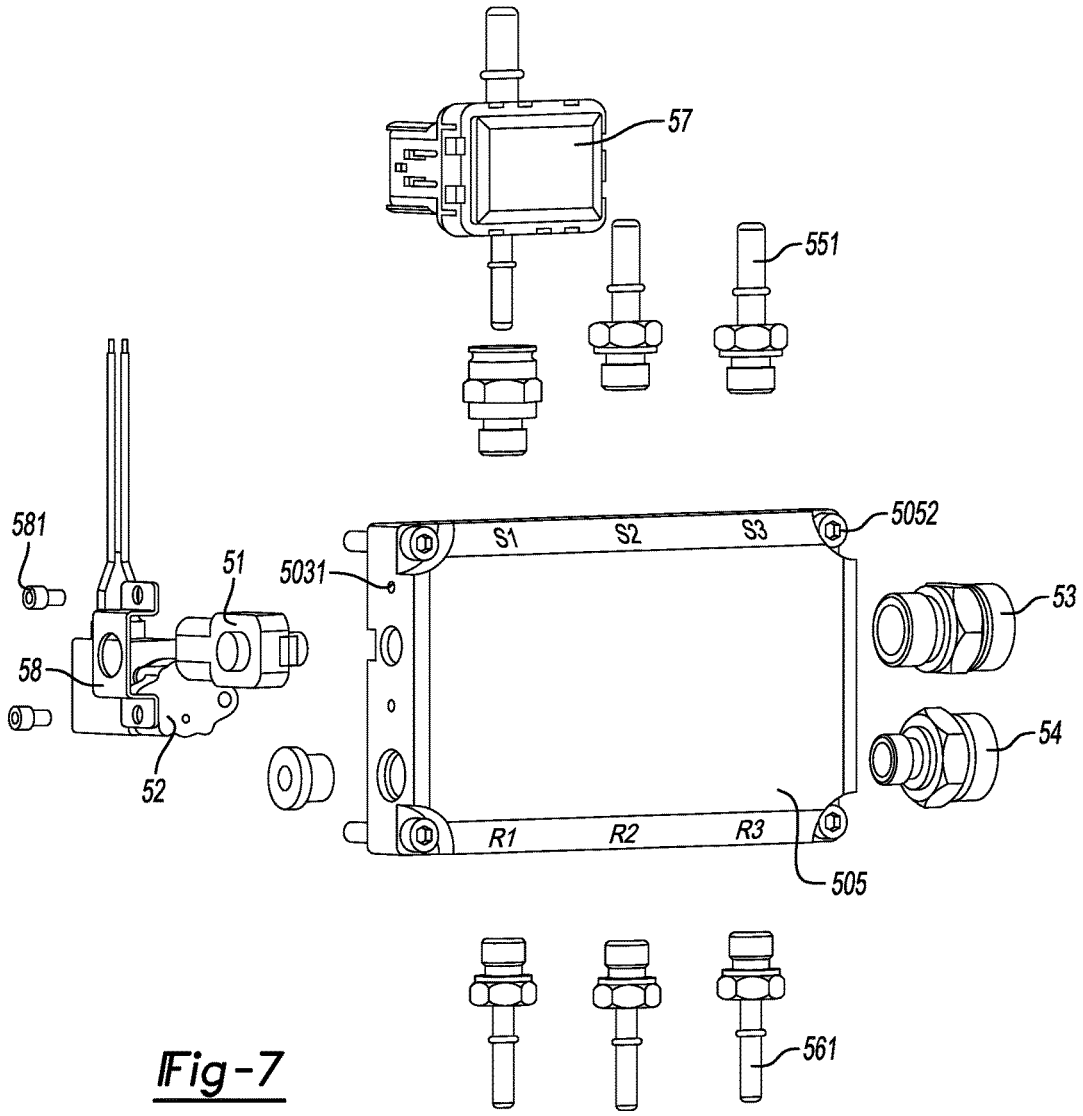
FIG. 7 shows an exploded three-dimensional view of a common rail according to the present invention with the mounting plates removed.

As shown in FIG. 7, said common rail (5) further comprises a fastening piece (58) which is held on the outside of said pressure sensor (51), and said fastening piece (58) is locked together with said threaded hole (5031) through a bolt (581) to fasten said pressure sensor (52) onto said housing (50).

The pressure control valve installed on said common rail (5) has three functions: 1. helping to build up the pressure in the urea pipeline, 2. stabilizing and controlling the pressure after the pressure has built up, 3. with the aid of contra-rotations of said pump (42), drawing the air in said urea tank (1) into the pipeline of said urea injection system to evacuate the urea solution from said pipeline before said urea injection system (100) stops.

To be specific, when the system just starts to build up pressure, a lot of air may exist in the pipeline. However, the compressibility of air easily leads to a pressure buildup failure. The pressure control valve designed in the present invention skillfully solves the problem. When the system just starts to build up pressure, said controller (41) controls the opening of said pressure control valve (for example, keeps said pressure control valve at a fixed opening angle or a changing opening angle) to connect said inlet passage (531) and said outlet passage (541) to provide one channel to release the air in the pipeline so that pressure can quickly be built up in the pipeline.

After the pressure buildup of the system is completed, said controller will quickly adjust the opening angle of said pressure control valve to ensure that the urea pressure in said common rail (5) is maintained around a set pressure and basically remains constant, thus achieving the aim of adjusting the pressure by controlling the back-flow volume of the urea solution.

Before said urea injection system (100) stops, said controller (41) opens said pressure control valve, said pump (42) contra-rotates to draw the air in said urea tank (1) into the pipeline of said urea injection system to evacuate the urea solution from said pipeline. It should be noted that "before said urea injection system (100) stops" means that said controller (41) has already received a signal indicating that the system is to stop. At this time, said nozzle (6) has stopped injection, but said pump (42) is still rotating (for example, contra-rotating). The purpose of evacuating the urea solution from said pipeline is to prevent the system from being damaged by freezing or expansion of the urea solution.

As shown in FIG. 6, said housing (50) further comprises said inlet passage (531) connected to the inlet connector (53), said outlet passage (541) connected to the outlet connector (54), at least one conveyance port (55) connected to said inlet passage (531), and at least one back-flow port (56) connected to said outlet passage (541). Said inlet passage (531) and said outlet passage (541) pass through said first end face (501) and/or second end face (502). In the illustrated implementation mode of the present invention, said inlet passage (531) and said outlet passage (541) both pass through said first end face (501). Said inlet passage (531) and said outlet passage (541) are parallel to each other, thus facilitating machining. In the illustrated implementation mode of the present invention, a plurality of said conveyance ports (55) are provided. To be specific, three conveyance ports (55) and three conveyance connectors (551) connected to said conveyance ports (55) are set on said third end face (503). Each conveyance connector (551) is perpendicular to said inlet passage (531). Said three conveyance connectors (551) are arranged at intervals between said first end face (501) and second end face (502). In the illustrated implementation mode of the present invention, a urea mass sensor (57) is installed on the conveyance connector (551) close to said third end face (503). Of course, in other implementation modes, said urea mass sensor (57) can also be installed on any conveyance connector (551); or a urea mass sensor (57) can also be installed on all three conveyance connectors (551). In the illustrated implementation mode of the present invention, the number of said back-flow ports (56) is also three, and said three back-flow ports (56) and three back-flow connectors (561) connected to said back-flow ports (56) are set on said fourth end face (504). Each back-flow connector (561) is perpendicular to said outlet passage (541). Said three back-flow connectors (561) are also arranged at intervals between said first end face (501) and second end face (502). Said conveyance ports (55) run through said third end face (503), and said back-flow ports (56) run through said fourth end face (504). The number of said back-flow connectors (561) is the same as the number of said conveyance connectors (551), but their mounting directions are the opposite. Each conveyance port (55) is aligned with a corresponding back-flow port (56).

In the illustrated implementation mode of the present invention, three of said nozzles (6) are provided. Each nozzle (6) is equipped with a conveyance pipeline (61) connected to said conveyance port (55) and a back-flow pipeline (62) connected to said back-flow port (56). With such settings, on the one hand, said nozzles (6) can spray a urea solution into said exhaust pipe (201) for a chemical reaction, and on the other hand, the urea solution flowing back can be utilized to cool said nozzles (6). The urea solution flowing back first all gathers in said common rail (5) through the back-flow pipeline (62), and then uniformly flows back into said urea tank (1) through the back-flow pipeline (300). In the prior art, a solution where said back-flow pipelines (62) are directly introduced into said urea tank (1) is usually adopted. In such a solution, each nozzle (6) requires an independent back-flow pipeline (62), and thus the cost is very high. In addition, in the applications of the present invention, especially in the exhaust processing system of a high-power engine, the pipelines between said urea tank (1) and said nozzles (6) are often long, and the prior back-flow design cannot satisfy the requirements.

Figure 9:
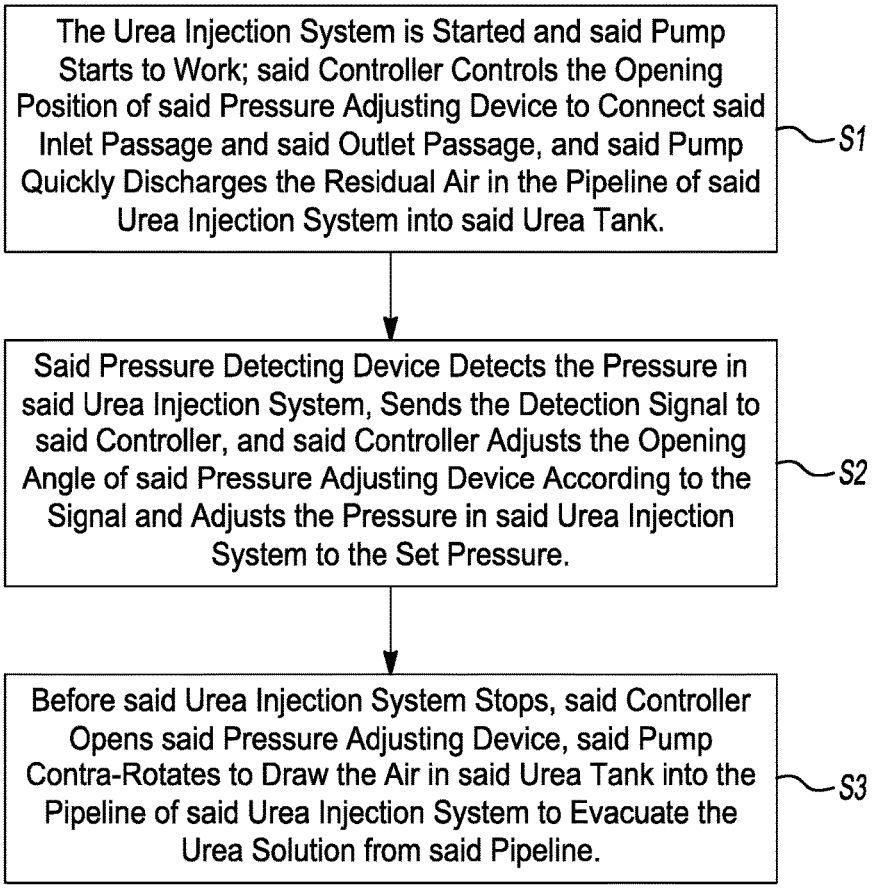
FIG. 9 shows a flowchart of a control method of a urea injection system according to the present invention.
Figure 10:
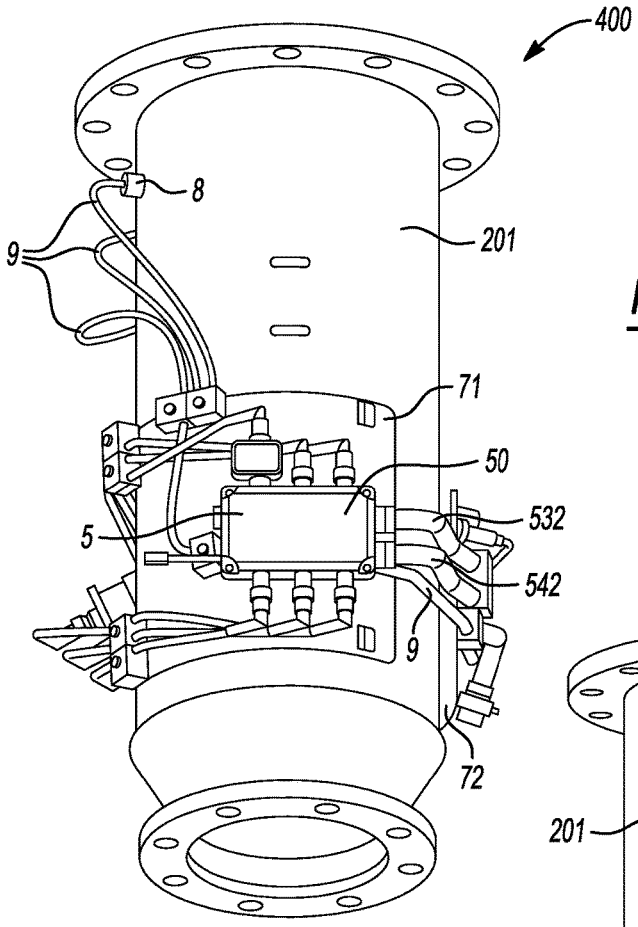
FIG. 10 is a three-dimensional view of an exhaust post-processing component according to the present invention, wherein said common rail is mounted on an exhaust pipe.
Figure 11:
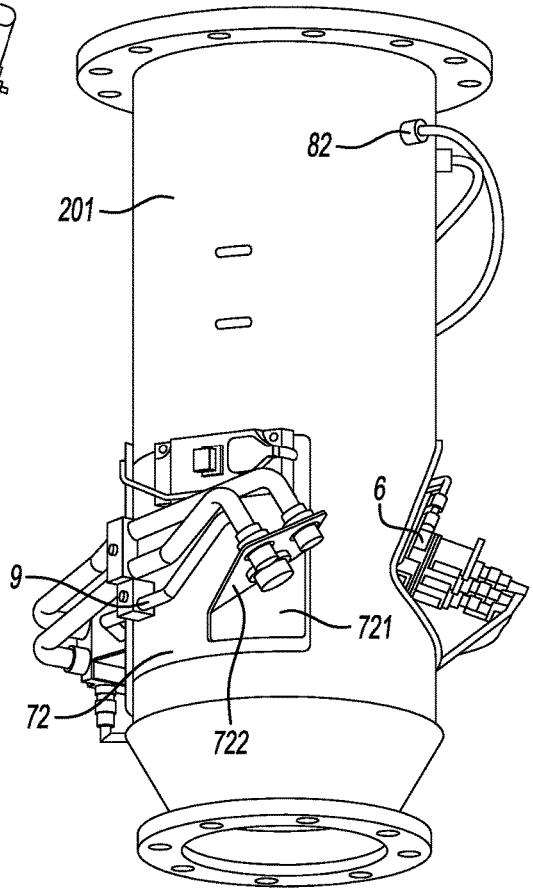
FIG. 11 shows another three-dimensional view of the exhaust postprocessing component shown in FIG. 10.
Figure 14:
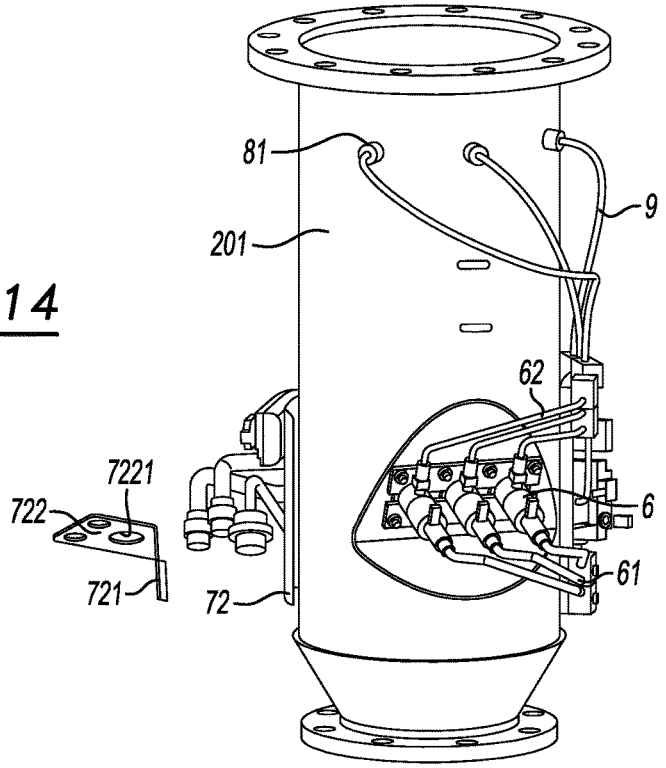
FIG. 14 shows another local exploded view of an exhaust postprocessing component according to the present invention.
Figure 15:
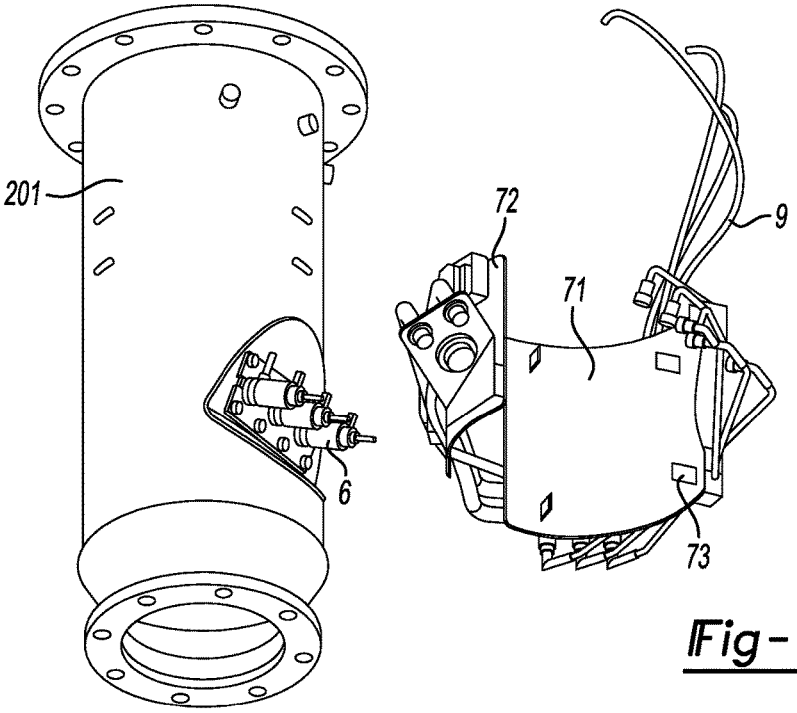
FIG. 15 shows yet another local exploded view of an exhaust postprocessing component according to the present invention.
Figure 16:
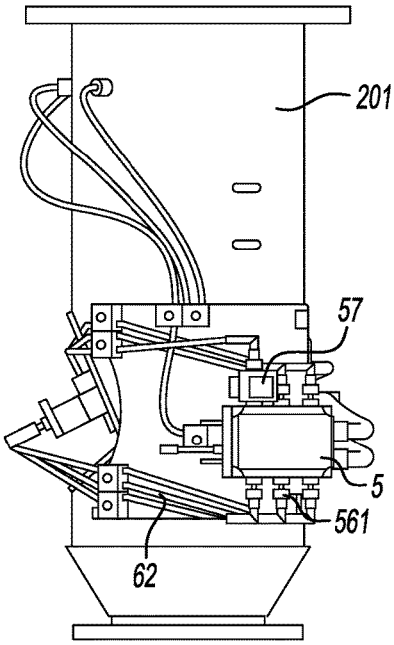
FIG. 16 shows a top view of FIG. 10.
Figure 17:
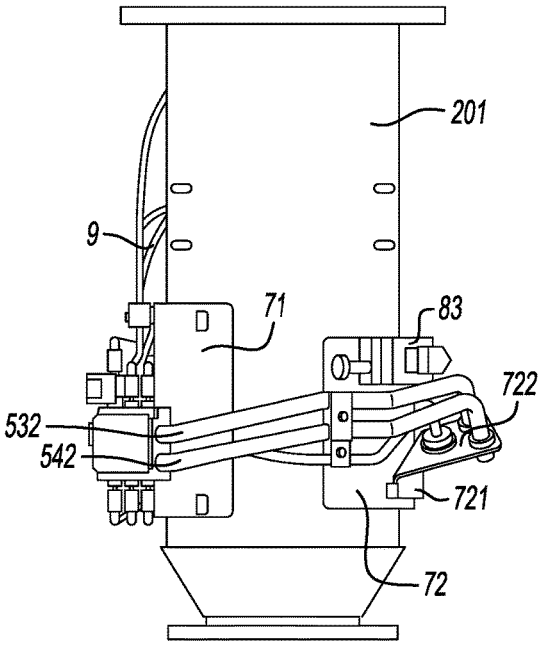
FIG. 17 shows a right side view of FIG. 16.
Figure 18:
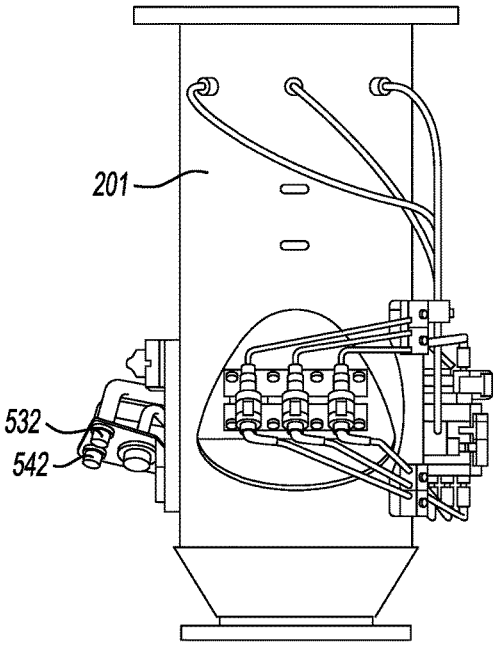
FIG. 18 shows a left side view of FIG. 16.
Figure 19:
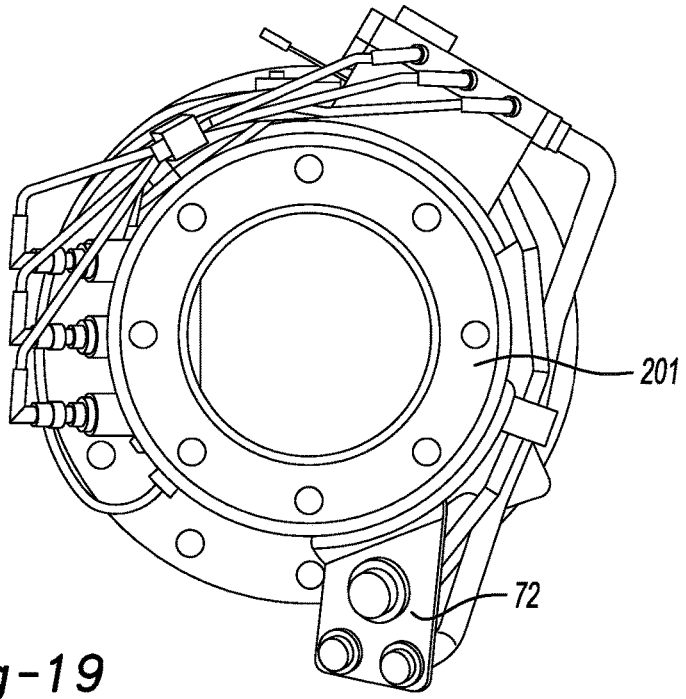
FIG. 19 shows a front view of FIG. 10.
Figure 20:
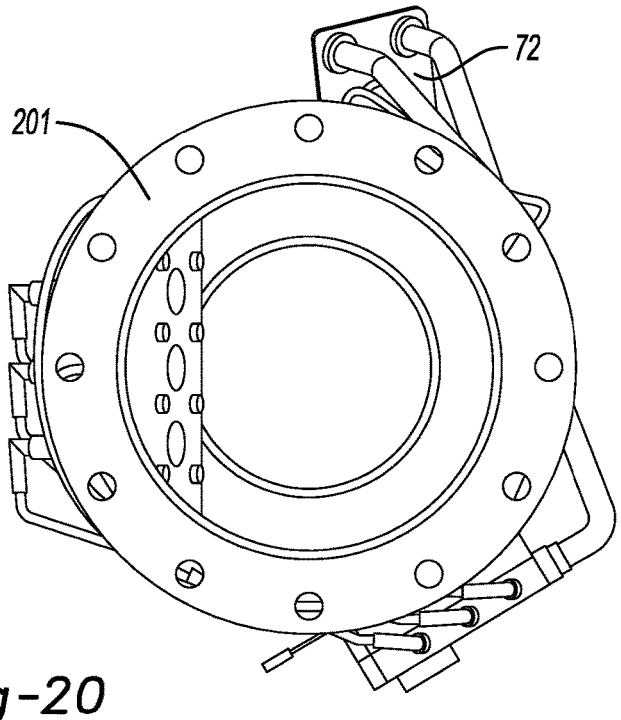
FIG. 20 shows a rear view of FIG. 10.

As shown in FIG. 9, the present invention further relates to a control method of the above-mentioned urea injection system (100) and the control method comprises the following steps:

S1: The urea injection system (100) is started and said pump (42) starts to work; said pressure adjusting device is opened at a fixed angle or changing angle under the control of said controller (41) to connect said inlet passage (531) and said outlet passage (541); said pump (42) quickly discharges the residual air in the pipeline of said urea injection system (100) into said urea tank (1) to realize quick pressure buildup.

S2: Said pressure detecting device (51) detects the pressure in said inlet passage (531), sends the detection signal to said controller (41), and said controller (41) adjusts the opening angle of said pressure adjusting device (52) according to the signal and adjusts the pressure in said urea injection system (100) to the set pressure.

S3: Before said urea injection system (100) stops, said controller (41) opens said pressure adjusting device (52), said pump (42) contra-rotates to draw the air in said urea tank (1) into the pipeline of said urea injection system (100) to evacuate the urea solution from said pipeline.

As shown in FIG. 10 to FIG. 20, in the illustrated implementation mode of the present invention, said common rail (5) is installed onto said exhaust pipe (201) to form an exhaust postprocessing component (400). Said exhaust postprocessing component (400) comprises said exhaust pipe (201), a first support (71) installed on said exhaust pipe (201), said common rail (5) installed on said first support (71), an inlet pipeline (532) and an outlet pipeline (542) connected to said common rail (5), many types of sensors (8), a wiring harness (9) connected to said sensors (8), and a second support (72). Said inlet pipeline (532), said outlet pipeline (54), and said wiring harness (9) are all gathered at said second support (72) to facilitate the connection of said exhaust postprocessing component (400) with other assemblies.

Said exhaust postprocessing component (400) is also equipped with a mounting block (73) located between said first support (71) and said exhaust pipe (201). Said mounting block (73) is welded to said exhaust pipe (201), with a certain clearance (7) reserved between said first support (71) and said exhaust pipe (201). Providing said clearance (7) can relieve high-temperature transfer from the exhaust pipe (201) to said first support (71) to protect said common rail (5) being affected. Preferably, heat insulation cotton is filled in said clearance (7). In addition, said common rail (5) is welded to said first support (71) with a pair of said mounting plates (5062), that is to say, said common rail (5) is separated from said exhaust pipe (201) by a distance said first support (71) to further relieve the high-temperature effect on the exhaust pipe (201). Said second support (72) comprises a fixed portion (721) welded on said exhaust pipe (201) and a mounting portion (722) forming an included angle with said fixed portion (721). In the illustrated implementation mode of the present invention, said fixed portion (721) is perpendicular to said mounting portion (722). Said mounting portion (722) is equipped with a plurality of mounting holes (7221), and said wiring harness (9), said inlet pipeline (532), and said outlet pipeline are all gathered in a corresponding mounting hole (7221). Of course, in other implementation modes, said fixed portion (721) can indirectly be installed on said exhaust pipe (201) in other ways. In the illustrated implementation mode of the present invention, said fixed portion (721) and said mounting portion (722) are formed by wholly bending a metal plate. In the illustrated implementation mode of the present invention, said exhaust postprocessing component (400) is further equipped with cable clips (91) used to separate said wiring harness (9) and pipe clips (92) used to separate said pipelines or pipes.

Said sensors (8) include pressure sensors (81), temperature sensors (82), and nitrogen-oxygen sensors (83) connected to said wiring harness (9). Of course, the types of said sensors (8) can be flexibly selected according to the design requirements of the system, and will not be described here.

In summary, the structure and layout of the entire exhaust postprocessing component (400) are made clear by gathering said wiring harness (9), said inlet pipeline (532), and said outlet pipeline (542) onto the mounting portion (722) of said second support (72). In addition, the gathering together of various interfaces greatly facilitates the installation of said exhaust postprocessing component (400) with other assemblies.

In addition, the above-mentioned embodiments are only used to describe the present invention, but not restrict the technical solutions described for the present invention. The understanding of the specification, for example, "passing through from front to back", which means passing through before any other part is installed, and the description of directions such as front, back, left, right, top, and bottom, should be based on those skilled in the art. Although a detailed description of the present invention is given in the specification by reference to the above-mentioned embodiments, those skilled in the art should understand that a person skilled in the art can still make modifications to or equivalent replacements in the present invention. Technical solutions and improvements thereto without departing from the spirit and scope of the present invention shall all fall within the scope of the claims of the present invention.

The invention claimed is:

1. An exhaust postprocessing component, comprising an exhaust pipe, a first support mounted on said exhaust pipe, a common rail mounted on said first support, an inlet pipeline and an outlet pipeline connected to said common rail, a sensor, and a wiring harness connected to said sensor; characterized in that said common rail comprises a housing, and a pressure detecting device and a pressure adjusting device installed on said housing, said housing comprising an inlet passage and an outlet passage, said pressure detecting device being connected to said inlet passage; said pressure adjusting device being connected between said inlet passage and said outlet passage, to be capable of connecting or disconnecting said inlet passage and said outlet passage; said engine exhaust postprocessing component further comprises a second support, and said wiring harness, said inlet pipeline and said outlet pipeline being gathered at said second support.

2. The exhaust postprocessing component as claimed in claim 1, wherein said exhaust postprocessing component is provided with a mounting block disposed between said first support and said exhaust pipe to create a clearance between said first support and said exhaust pipe.

3. The exhaust postprocessing component as claimed in claim 2, wherein said mounting block is welded to said exhaust pipe; said exhaust postprocessing component is further provided with heat insulation cotton filled in said clearance.

4. The exhaust postprocessing component as claimed in claim 1, wherein exhaust postprocessing component is provided with a pair of mounting plates for mounting said common rail onto said first support, said pressure adjusting device being located between said pair of mounting plates.

5. The exhaust postprocessing component as claimed in claim 4, wherein one end of said mounting plate is welded to said first support, and the other end of said mounting plate is fixed by screws to the housing of said common rail.

6. The exhaust postprocessing component as claimed in claim 1, wherein said second support comprises a fixed portion directly or indirectly fixed to said exhaust pipe and a mounting portion forming an included angle with said fixed portion; said mounting portion being equipped with a plurality of mounting holes, and said wiring harness, said inlet pipeline, and said outlet pipeline all being gathered in a corresponding mounting hole.

7. The exhaust postprocessing component as claimed in claim 6, wherein said fixing portion and said mounting portion are formed by bending a metal plate, said mounting portion being perpendicular to said fixed portion.

8. The exhaust postprocessing component as claimed in claim 1, wherein said housing comprises a plurality of conveyance ports connected to said inlet passage and a plurality of back-flow ports connected to said outlet passage, said housing roughly taking the shape of a cuboid, comprising a first end face, a second end face, a third end face, and a fourth end face, wherein said first end face and said second end face are disposed opposite each other; and said third end face and said fourth end face are disposed opposite each other; said inlet passage and said outlet passage pass through said first end face and/or said second end face, said conveyance port passing through said third end face, said back-flow port passing through fourth end face.

9. The exhaust postprocessing component as claimed in claim 8, wherein said common rail is provided with conveyance connectors connected to each conveyance port and back-flow connectors connected to each back-flow port, said inlet passage and said outlet passage being parallel to each other, said conveyance connectors being perpendicular to said inlet passage, said back-flow connectors being perpendicular to said outlet passage.

10. The exhaust postprocessing component as claimed in claim 9, wherein the number of said back-flow connectors is the same as the number of said conveyance connectors; the direction of said conveyance connectors is opposite that of said back-flow connectors, and each of the conveyance ports is aligned with the corresponding back-flow port.

* * * * *